US006967001B2

(12) United States Patent
Aslund

(10) Patent No.: US 6,967,001 B2
(45) Date of Patent: Nov. 22, 2005

(54) METHOD FOR SINTERING A CARBON STEEL PART USING A HYDROCOLLOID BINDER AS CARBON SOURCE

(75) Inventor: Christer Aslund, Torshälla (SE)

(73) Assignee: Metals Process Systems, (FR)

( * ) Notice: Subject to any disclaimer, the term of this patent is extended or adjusted under 35 U.S.C. 154(b) by 0 days.

(21) Appl. No.: 10/018,659

(22) PCT Filed: Apr. 26, 2001

(86) PCT No.: PCT/SE01/00905

§ 371 (c)(1),
(2), (4) Date: Dec. 21, 2001

(87) PCT Pub. No.: WO01/83139

PCT Pub. Date: Nov. 8, 2001

(65) Prior Publication Data

US 2002/0159910 A1 Oct. 31, 2002

(30) Foreign Application Priority Data

Apr. 28, 2000 (SE) ..... 0001568

(51) Int. Cl.[7] ..... B22F 3/12; C22C 33/00
(52) U.S. Cl. ..... 419/54; 419/36; 419/38; 75/246
(58) Field of Search ..... 419/36, 37, 38, 419/54; 75/246

(56) References Cited

U.S. PATENT DOCUMENTS

| | | | | |
|---|---|---|---|---|
| 2,775,566 | A | 12/1956 | Crowley | |
| 3,811,878 | A | 5/1974 | Chao et al. | |
| 3,989,518 | A | 11/1976 | Rueckl | |
| 4,797,251 | A | 1/1989 | Sakuramoto et al. | |
| 5,258,151 | A * | 11/1993 | Bayer et al. | 264/63 |
| 5,460,641 | A | 10/1995 | Åslund et al. | |
| 5,734,959 | A * | 3/1998 | Krebs et al. | 19/2 |
| 5,744,532 | A * | 4/1998 | Kankawa et al. | 524/440 |

FOREIGN PATENT DOCUMENTS

WO WO 99/36214 A1 7/1999

OTHER PUBLICATIONS

An Introduction to Metallurgy, 2nd ed., Joseph Newton, 1947, p. 201.*

* cited by examiner

*Primary Examiner*—Daniel Jenkins
(74) *Attorney, Agent, or Firm*—Rothwell, Figg, Ernst & Manbeck, P.C.

(57) ABSTRACT

The invention refers to a new method for preparing sintered structural parts of carbon or tool steels or high speed steel having a carbon content of up to 2% by weight, wherein an agglomerated spherical powder comprising at least 0.5% of a thermo-reversible hydrocolloid is pressed to a green body of high density which is then heated at 450–650° C. to remove the non-carbon content of the hydrocolloid and subsequently sintered at about 1100–1400° C. to structural parts having high strength properties.

20 Claims, No Drawings

METHOD FOR SINTERING A CARBON STEEL PART USING A HYDROCOLLOID BINDER AS CARBON SOURCE

BACKGROUND OF THE INVENTION

Carbon steels and tool steels as well as other steels and alloys with a high carbon content are primarily characterized by high strength properties. The yield strength, tensile strength and apparent hardness increase with an increasing carbon content, and correspondingly the elongation decreases.

It is hardly possible to produce a structural part from a carbon steel powder having a carbon content of above about 0.1% by pressing and sintering, as this powder is very hard and the resulting green density of the green body obtained by pressing will be very low. In order to get a good compressibility the powder could be soft annealed, but this is a very costly operation that has to be performed in a protective atmosphere. The carbon is therefor usually added as a graphite powder before the pressing. For the manufacturing of parts of a high carbon steel from a metal powder said powder is mixed with up to 1% by weight of carbon in the form of fine grain graphite. The graphite powder which is used for the addition of carbon to a steel or an alloy is made by grinding of either natural or synthetic graphite. Natural graphite has for long been dominating owing to a higher reactivity during the sintering process, but today there are also synthetic ones having said properties.

The "green density", that is the density of the green body reached after the pressing operation, is an important property. A high green density will give better mechanical properties, higher final density, and better tolerances after sintering. In order to obtain a high green density the ductility of the powder must be high, as the pressure, which can be applied during the compacting, should normally not be higher than 800 MPa due to the tool life. However, due to the fact that graphite is added, the final density after sintering will be low. This is due to the fact that graphite has a low density and takes up volume during pressing. When it diffuses into the part as carbon the density increase is restricted. It is also well known that when mixing graphite and plain carbon steel it is difficult to obtain a perfect mixing, which leads to inhomogeneities with areas higher and lower in carbon, which gives uneven results and different properties of the sintered body. This is especially true for irregular powders like water atomized powder.

Today structural parts of carbon and tool steels are therefore, when good mechanical properties are required, mainly produced by forging, casting or hot isostatic pressing followed by machining.

PRIOR ART

U.S. Pat. No. 5,460,641 discloses the production of pieces from powders of spherical particles by compression and sintering. Spherical powder particles are obtained by pulverisation of a liquid metal or alloy using a gaseous jet, such as a jet from a neutral gas, and are preferred to angular particles because of the much lower oxide content. The mechanical strength of a crude piece obtained after cold compression of spherical particles, the green strength, is, however, inadequate for it to be handled and in particular to be ejected from the mould and transferred to the sintering furnace. In order to improve the green strength the spherical particles are mixed with a hydrocolloid, such as a solution of gelatin, and agglomerated into granules, which are then compressed and sintered. Due to the purity of the powder the granules sinter to very high density. Normally the hydrocolloid is driven off before the final sintering in air, e.g. at 450–500° C., which removes the carbon completely from the binder without giving very much oxides. This is important for certain products such as stainless steel.

WO 99/36214 describes a process for compressing a spherical metal powder agglomerated with at least 0.5% by weight of a thermo-reversible hydrocolloid as a binder to a green body having a high density. Said green body can then be sintered to products with full or near full density.

U.S. Pat. No. 4,797,251 describes a process for forming a metal layer from an iron powder mixed with an organic binder on a steel base material without the layer peeling off. During a subsequent sintering the binder is decomposed giving a residual carbon content of at least 0.5% by weight. The improved adhesive and fixing force could not be obtained if the residual carbon content was less than about 5%.

U.S. Pat. No. 3,989,518 discloses the use of organic binder particles mixed with metal particles in order to obtain a sintered preform of sufficient bonding strength for further processing. The organic binder consists of compounds, which on heating to the sintering temperature decompose to polycyclic structures with sufficient bonding strength. Preferably the binder is present in an amount sufficient to reduce the oxygen content of metal particles composed of a ferrous alloy.

DESCRIPTION OF THE INVENTION

It has now surprisingly been found that by using the agglomeration technique, such as described in U.S. Pat. No. 5,460,641 or in WO 99/36214, it will be possible to control the carbon content of a structural part after sintering in an ordered manner. An hydrocolloid, which has been added in an amount of 0.5–2%, preferably about 1.5% by weight of the agglomerate, contains about 50% carbon, in addition to oxygen and nitrogen, which means that it can be used as a carbon source for the production of steels and alloys which are to have a high content of carbon and which can not be produced from a high carbon steel powder.

The present invention refers to a method for preparing a sintered structural steel part with a carbon content of up to 2% by weight, wherein an agglomerated spherical soft iron-based powder comprising at least 0.5% by weight of a thermo-reversible hydrocolloid as a binder is pressed to a green body of high density, which is characterized in that the green body is heated to a temperature of about 450–650° C. under a controlled, such as inert, atmosphere to remove the non-carbon content of the binder and then sintered at a temperature of about 1100–1400° C. to allow the remaining carbon to diffuse homogeneously into the sintered body, giving structural parts of high density and having high strength properties.

The structural steel parts obtained according to the invention can be parts of carbon and tool steels, as well as high speed steel parts all having a high content of carbon and high strength properties.

According to a preferred method the hydrocolloid is gelatin.

If a structural part is to be prepared of a steel having a carbon content above about 0.5% by weight the agglomerated powder should in addition comprise fine-grained graphite powder.

The heating of the green body at about 450–650° C. should preferably take place under a protective atmosphere to prevent oxidation As examples of inert gases can be mentioned argon or argon mixed with a minor amount of hydrogen, nitrogen or cracked ammonia giving for example a mixture of 25% nitrogen and 75% hydrogen. In this type of atmosphere most of the carbon of the binder is retained in the powder. If it would be necessary to decrease the carbon content, and not only the non-carbon content, of the binder the heating at 450–650° C. should take place under an atmosphere which allows part of the carbon to be removed, such as a mixture of a protective atmosphere and air or oxygen.

Structural parts prepared by the method of the invention can preferably be used for the production of small details in large series, such as spur gears and transmission parts for vehicles. The parts are characterized by an almost perfect homogeneity of the carbon distribution due to the even spread of the binder on the spherical powder during the agglomeration process, which gives very even properties in the finished product.

EXAMPLES

Example 1

Production of a Part of Carbon Steel with 0.4% C

A spherical powder of plain carbon steel having a carbon content of about 0.05% by weight and a grain size of maximum 150 μm was mixed with an aqueous solution of gelatin to a pasty mixture which was then granulated and dried giving an agglomerated powder containing 1.5% by weight of the gelatin binder. The agglomerated powder was then uniaxially pressed in a conventional hydraulic press with a ram speed of 0.2–0.3 m/s and a tool pressure of 800 $N/m^2$ to a green body having a density of 90–92% of the theoretical value.

The green body was then placed in an oven and heated to a temperature of 475° C. for 2 hours under a protective atmosphere of argon+5% $H_2$. By this heating the gelatine is decomposed, and the content of oxygen and nitrogen has disappeared, but most of, the carbon has been retained. After sintering at 1350° C. for 2 h in vacuum a carbon steel part is obtained with a carbon content of 0.42% as analysed by a Leco Analyzer (Leco Incorporated, USA) and a density of 97.8% of the theoretical value.

Example 2

Production of a Part of the Tool Steel AISI 420

AISI 420 is a well-known steel grade in the stainless tool steel area. It is a hardenable martensitic steel grade and therefor interesting in applications like tools for plastic injection moulding where corrosive environments are actual. The composition of the steel is: 12% Cr, 0.4% C and a remainder of iron.

A spherical powder having the composition 12% Cr, 0.05% C and a remainder of iron, and a grain size of maximum 100 μm (from Anval Nyby AB, Torshalla, Sweden) was mixed with an aqueous solution of gelatin to a binder content of 1.5% by weight as described in Example 1. After pressing of the agglomerated powder to a green body and heating and sintering, mainly as described in Example 1, a steel part is obtained having a carbon content of 0.45% as analysed by a Leco Analyzer.

Example 3

Production of a Part of a High Speed Steel T15

A structural part of a high speed steel T15, having a typical analysis of 1.5% C, 0.25% Si, 0.25% Mn, 4.2% Cr, 12% W, 0.5% Mo, 4.7% V, 5.0% Co, and the balance Fe, was aimed at. Owing to the high carbon content and the strong carbide forming properties of Cr, W and V a powder of said composition would be extremely hard after atomising because of the quick cooling. To soft anneal such a powder under protective atmosphere would also be very difficult and expensive as a high soft annealing temperature would be necessary, which in turn would bring about a tendency to sinter the powder.

According to the invention a steel powder having the above composition apart from a lower carbon content of about 0.05% is produced. This powder is soft and can be pressed. Gelatin in an amount of up to 1.5% by weight is mixed with water, about 3.5%, at a constant temperature of about 55° C. for 15 minutes. Then 1% of pure graphite in extremely fine-grained form (particle size 0.1–1 μm) is added to the solution under stirring at the same constant temperature. The agglomerated powder is then produced as described in Example 1. By mixing the powder and the hydrocolloid with the fine-grained graphite in a water solution an extremely uniform distribution of the binder and the graphite is obtained.

The agglomerated powder could then be pressed to a density of 83%. The green body is then debinded in pure argon at a temperature of 475° C. and after that sintered in a mixture of 10% $H_2$ and 90% $N_2$ at 1220° C. to a complete density. The carbon content of the final structural part was 1.45% and the distribution of carbide extremely even.

What is claimed is:

1. A method for preparing a sintered structural steel part with a carbon content of about from 0.1% up to 2% by weight, comprising:

pressing an agglomerated spherical soft iron-based powder containing about from 0.5% to 2% by weight of a thermo-reversible hydrocolloid as a binder to a green body of high density, heating the green body to a temperature of about 450–650° C. under a controlled atmosphere to remove the non-carbon content of the binder, and then sintering the green body at a temperature of about 1100–1400° C. to allow the carbon remaining in the binder to diffuse homogeneously into the sintered body, giving structural parts of high density and having high strength properties.

2. A method according to claim 1, characterised in that the hydrocolloid is gelatin.

3. A method according to claim 1, characterised in that the agglomerated powder in addition comprises fine-grained graphite powder.

4. A method according to claim 1, characterised in that the heating at 450–650° C. takes place under a protective atmosphere to prevent oxidation.

5. A method according to claim 1, characterised in that the heating at 450–650° C. takes place under an atmosphere which allows part of the carbon to be removed.

6. Structural steel part of high density and high strength, characterised in being prepared by a method according to claim 1.

7. The method according to claim 1, wherein said method prepares a sintered structural steel part with a carbon content of more than about 0.4% by weight.

8. The method according to claim 1, wherein said method prepares a sintered structural steel part with a carbon content of more than about 0.5% by weight.

9. The method according to claim 1, wherein said method prepares a sintered structural steel part with a carbon content of more than about 0.145% by weight.

10. The method according to claim 1, wherein said method prepares a sintered structural steel part with a carbon content of about 0.4% to 2% by weight.

11. The method according to claim 3, wherein said method prepares a sintered structural steel part with a carbon content of more than about 0.145% by weight.

12. The method according to claim 3, wherein said method prepares a sintered structural steel part with a carbon content of about 0.4% to 2% by weight.

13. A method for making a high strength steel part from a soft iron-based powder, comprising:

mixing a soft iron-based powder with a thermo-reversible hydrocolloid binder into an agglomerated powder, said hydrocolloid binder acting as a means to add carbon to the powder, pressing said agglomerated powder to a green body, heating the green body to a temperature of about 450–650° C. under a protective atmosphere that prevents oxidation to remove the non-carbon content of the binder substantially, and sintering the green body at a temperature of about 1100–1400° C. to allow the carbon remaining in the binder to diffuse homogeneously into the sintered body and create a structural part of high strength.

14. The method according to claim 13, wherein said protective atmosphere enables removal of the non-carbon content substantially without removal of the carbon content.

15. The method according to claim 14, wherein said method prepares a steel part with a carbon content of more than about 0.4% by weight.

16. The method according to claim 14, wherein said method prepares a steel part with a carbon content of more than about 0.5% by weight.

17. The method according to claim 14, wherein said method prepares a steel part with a carbon content of more than about 0.145% by weight.

18. The method according to claim 1, wherein said method prepares a steel part with a carbon content of about 0.4% to 2% by weight.

19. A method for making a high strength steel part by simple pressing and sintering of metal powder, comprising:

mixing an agglomerated powder having a soft iron-based powder and a binder that acts as a means to add carbon to the powder, pressing said agglomerated powder to a green body, heating the green body under a protective atmosphere that prevents oxidation to remove the non-carbon content of the binder substantially without removal of carbon content from the binder, and sintering the green body to create a structural part of high strength.

20. The method according to claim 19, wherein said method prepares a steel part with a carbon content of about 0.4% to 2% by weight.

* * * * *